US009068304B2

(12) United States Patent
Mannebach et al.

(10) Patent No.: US 9,068,304 B2
(45) **Date of Patent: *Jun. 30, 2015**

(54) AUTOMOTIVE MACHINE FOR PRODUCING CARRIAGEWAYS

(71) Applicant: Wirtgen GmbH, Windhagen (DE)

(72) Inventors: Thomas Mannebach, Langenfeld (DE); Peter Busley, Linz am Rhein (DE); Karsten Buhr, Willroth (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/465,936

(22) Filed: Aug. 22, 2014

(65) Prior Publication Data

US 2014/0375110 A1 Dec. 25, 2014

Related U.S. Application Data

(63) Continuation of application No. 13/291,842, filed on Nov. 8, 2011, now Pat. No. 8,840,191, which is a continuation of application No. 13/034,131, filed on Feb. 24, 2011, now Pat. No. 8,075,063, which is a continuation of application No. 10/575,086, filed as application No. PCT/EP2004/052902 on Nov. 10, 2004, now Pat. No. 7,918,512.

(30) Foreign Application Priority Data

Dec. 4, 2003 (DE) ..... 103 57 074

(51) Int. Cl.
*E01C 23/088* (2006.01)
*E01C 21/00* (2006.01)

(Continued)

(52) U.S. Cl.
CPC ..... *E01C 23/088* (2013.01); *Y10T 29/49826* (2015.01); *E01C 21/00* (2013.01); *E01C 23/065* (2013.01); *E01C 2301/30* (2013.01); *E01C 23/127* (2013.01)

(58) Field of Classification Search
USPC ..... 299/39.1, 39.4, 39.6; 404/90–94
See application file for complete search history.

(56) References Cited

U.S. PATENT DOCUMENTS 932,591 A 8/1909 Smith
2,009,500 A 7/1935 Kramer (Continued)

FOREIGN PATENT DOCUMENTS

DE 719441 4/1942
DE 3921875 A1 1/1991

(Continued)

OTHER PUBLICATIONS

"Wirtgen Recycler/Stabilizer WR 2500" Brochure, undated but admitted to be prior art.

*Primary Examiner* — Sunil Singh
(74) *Attorney, Agent, or Firm* — Lucian Wayne Beavers; Patterson Intellectual Property Law, PC

(57) ABSTRACT

An automotive machine (1) for producing carriageways by stabilizing insufficiently stable soils or by recycling road surfaces includes a machine chassis (4), a working drum (20) mounted on pivoting arms to pivot in relation to the machine chassis (4), a combustion engine (32) supported by the machine chassis, and at least one mechanical power transmission device (36) transferring the drive power from the engine to the working drum (20).

19 Claims, 4 Drawing Sheets

(51) Int. Cl.
*E01C 23/06* (2006.01)
*E01C 23/12* (2006.01)

(56) References Cited

U.S. PATENT DOCUMENTS

| | | | | |
|---|---|---|---|---|
| 2,042,837 | A | 6/1936 | Gardner | |
| 2,062,232 | A | 11/1936 | Pogue | |
| 2,111,134 | A | 3/1938 | Allin | |
| 2,787,943 | A | 4/1957 | Browning | |
| 2,865,268 | A | 12/1958 | Gardner | |
| 2,934,327 | A | 4/1960 | Lewis | |
| 3,007,687 | A | 11/1961 | Hatcher | |
| 3,007,688 | A | 11/1961 | Hatcher | |
| 3,037,755 | A | 6/1962 | Hatcher | |
| 3,045,992 | A | 7/1962 | Asbury | |
| 3,063,690 | A | 11/1962 | Cornell | |
| 3,195,957 | A | 7/1965 | Hatcher | |
| RE25,838 | E | 8/1965 | Hatcher | |
| 3,208,796 | A | 9/1965 | Hatcher | |
| 3,272,560 | A | 9/1966 | Hatcher | |
| 3,387,891 | A | 6/1968 | Simms et al. | |
| 3,409,088 | A | 11/1968 | Lindbeck et al. | |
| 3,464,737 | A | 9/1969 | Haase et al. | |
| 3,606,469 | A | 9/1971 | Hughes | |
| 3,703,316 | A | 11/1972 | Hatcher et al. | |
| 3,765,724 | A | 10/1973 | Hatcher et al. | |
| 3,779,606 | A | 12/1973 | Hatcher et al. | |
| 3,779,608 | A | 12/1973 | Hatcher et al. | |
| 3,902,760 | A | 9/1975 | Ellis | |
| 4,175,788 | A | 11/1979 | Jacobson et al. | |
| 4,193,636 | A | 3/1980 | Jakob | |
| 4,342,485 | A | 8/1982 | Tuneblom | |
| 4,456,303 | A | 6/1984 | Due | |
| 4,516,808 | A | 5/1985 | Staab et al. | |
| 4,573,826 | A | 3/1986 | Piovesan | |
| 4,697,850 | A | 10/1987 | Tuneblom | |
| 4,786,111 | A | 11/1988 | Yargici | |
| 4,896,995 | A | 1/1990 | Simmons | |
| 4,929,121 | A | 5/1990 | Lent et al. | |
| 4,938,537 | A | 7/1990 | Rife, Jr. et al. | |
| 4,946,307 | A | 8/1990 | Jakob | |
| 5,190,398 | A | 3/1993 | Swisher, Jr. | |
| 5,354,147 | A | 10/1994 | Swisher, Jr. | |
| 5,388,893 | A | 2/1995 | Maxwell et al. | |
| 5,676,490 | A | 10/1997 | Nelson | |
| 5,893,677 | A | 4/1999 | Haehn et al. | |
| 5,908,224 | A | 6/1999 | Santos | |
| 6,467,201 | B1 | 10/2002 | McSharry et al. | |
| 6,877,818 | B1 | 4/2005 | Gaertner et al. | |
| 7,144,087 | B2 | 12/2006 | Haroldsen et al. | |
| 7,918,512 | B2 * | 4/2011 | Mannebach et al. | 299/39.4 |
| 8,075,063 | B2 * | 12/2011 | Mannebach et al. | 299/39.6 |
| 8,840,191 | B2 * | 9/2014 | Mannebach et al. | 299/39.6 |

FOREIGN PATENT DOCUMENTS

| | | | |
|---|---|---|---|
| DE | 19513551 | A1 | 11/1995 |
| EP | 0779396 | A1 | 6/1997 |
| WO | 9624725 | A1 | 2/1996 |

* cited by examiner

AUTOMOTIVE MACHINE FOR PRODUCING CARRIAGEWAYS

BACKGROUND OF THE INVENTION

The invention relates to an automotive machine for producing carriageways. Such machines are needed for the conditioning of material, namely the stabilization of insufficiently stable soils, the pulverization of hard asphalt pavements to the recycling of bound or unbound carriageway surfaces.

The known construction machines mostly show a working drum that revolves in a working chamber and is generally arranged in a height-adjustable manner for adjustment to the required milling depth and the surface to be worked. An adjustment of the slope can be effected by means of the running gear.

Adapted to the particular applications, the particular processes, such as removing and crushing the milled carriageway material, adding binding agents, mixing and spreading added materials, take place in this working chamber that is confined by a cover. A detailed explanation of the tasks to be solved by such machines and of the problems occurring can be inferred from WO 96/24725, which is referred to herewith in terms of content.

In the construction machine described therein, the cover is firmly attached to the machine chassis. The combustion engine for the drive power is mounted on a pivoting bracket, in the pivoting arms of which the milling drum is also mounted on both sides. The device, consisting of pivoting bracket with combustion engine and pivoting arms with milling drum, is mounted to pivot in the machine chassis. This arrangement influences any energy, substance and signal flow from and to the combustion engine in an unfavourable manner.

A further prior art is known from DE 3921875. The machine described therein shows a milling drum mounted between two pivoting arms that is surrounded by a height-adjustable cover. The combustion engine for the drive shows a hydraulic pump for the milling drive and a drive pump, both of which are coupled to a combustion engine arranged in front of the front axle of the running gear in a longitudinal direction. Here, the combustion engine is arranged in a fixed manner at the machine chassis but in an unfavourable manner in front of the operator's platform, which impedes the view, and in particular in front of the front axle, which adversely affects the position of the machine's centre of gravity. Furthermore, the hydraulic drive of the milling drum has a poor efficiency.

U.S. Pat. No. 5,354,147 describes a prior art with the features of the pre-characterizing clause. Of disadvantage here are the considerable design effort and the unfavourable weight distribution of the machine weight due to the combustion engine installed in front of the front axle. The arrangement of the engine in a longitudinal direction requires an additional gearbox, which makes the machine more expensive and more susceptible and reduces the efficiency of the milling drum drive.

Starting from a prior art in accordance with U.S. Pat. No. 5,354,147, the purpose of the invention consists in creating an automotive machine for producing carriageways that facilitates a mechanical direct drive of the working drum at a generally more stiff drive system and improved position of the centre of gravity.

The invention provides in a favourable manner that the combustion engine is arranged in a fixed manner at the machine chassis between the pivoting arms and that at least one mechanical power transmission device, together with the working drum mounted in the pivoting arms, can be pivoted about the output shaft of the combustion engine.

The advantage of the mechanical drive is that, due to the direct coupling of the combustion engine and the milling drum, an increased torque can be realized and drive losses are reduced, since no mechanical energy needs to be converted into hydraulic energy first and then back again into mechanical energy. At the same time, the drive system is stiffer when compared to a hydraulic drive system.

Arranging the output shaft of the combustion engine parallel to the shaft of the working drum allows the working drum with the power transmission device to be pivoted about the axis of rotation of the output shaft in a favourable manner without requiring additional mechanical elements. In doing so, the combustion engine can be installed transversely to the direction of travel in a favourable manner. Because the combustion engine is attached to the machine chassis in a fixed manner, suction and exhaust pipes as well as supply lines (e.g. for fuel, cooling liquid, engine electrics, hydraulics, etc.) need not be designed in a flexible manner.

Arranging the combustion engine between the support of the pivoting arms in the machine chassis has the advantage of a space-saving design and enables the power transmission device to be coupled directly to the output shaft at the combustion engine.

Between the output shaft and the power transmission device, a clutch can also be arranged in combination with a pump transfer gearbox.

In one preferred embodiment, it is intended that the output shaft of the combustion engine is arranged coaxially with the crankshaft axle of the combustion engine.

An operator's platform is preferably arranged in front of the combustion engine in the direction of travel. In a particularly favourable design, the operator's platform can be arranged in front of the front wheels. This arrangement has the additional advantage that the operator's platform can be movable in transverse direction.

The running gear can show front and rear wheels, whereby the front or the rear or all wheels are driven. The operator's platform can preferably be arranged in front of the axles of the front wheels.

The running gear preferably shows front steerable and/or rear steerable wheels.

The arrangement of the combustion engine between the drive axles is favourable for the weight distribution and enables the contact pressure on the working drum to be increased.

It is understood that the running gear can also show other drive means, e.g. track chains, in lieu of wheels. The preferred embodiment is provided with individual wheels that can, however, also be jointly controlled.

At least one of the pivoting arms, which are mounted to pivot in the machine chassis, receives the power transmission device between the combustion engine and the working drum.

In principle, however, there is also the possibility of guiding the output shaft through both sides of the transversely installed combustion engine and to provide a power transmission device in both pivoting arms. If a mechanical power transmission device is intended on one side only, the pivoting arm on the other side can be designed in a flat manner so that milling close to the edge is possible on this so-called zero side, i.e. the distance of the front edge of the working drum from an obstacle can be minimized on this zero side.

The working drum is coupled to a lifting device showing a link mechanism and attached to the machine chassis, by means of which the milling depth can be set.

The working drum can be coupled to one lifting device each on both front ends, whereby the movements of both lifting devices are synchronized.

In detail, the lifting device can show two pull rods running parallel to each other that are flexibly mounted at the pivoting arms on both sides at the working drum.

The lifting device can show at least one two-armed lever, one lever arm of which is connected to the free end of the pull rods and the other lever arm of which is flexibly coupled to a piston cylinder unit that is attached to the machine chassis.

The link mechanism enables the transmission of high forces due to the leverage ratio and enables a large stroke at a low design height.

In case of an arrangement of two-armed levers on both sides, it is intended that both levers are connected to each other in a non-rotatable manner by a coupling device that runs parallel to the shaft of the working drum and is mounted in the machine chassis, e.g. a connecting pipe.

In the following, embodiments of the invention are explained in more detail with reference to the drawings. The following is shown:

DESCRIPTION OF THE PREFERRED EMBODIMENTS

Figure 1:
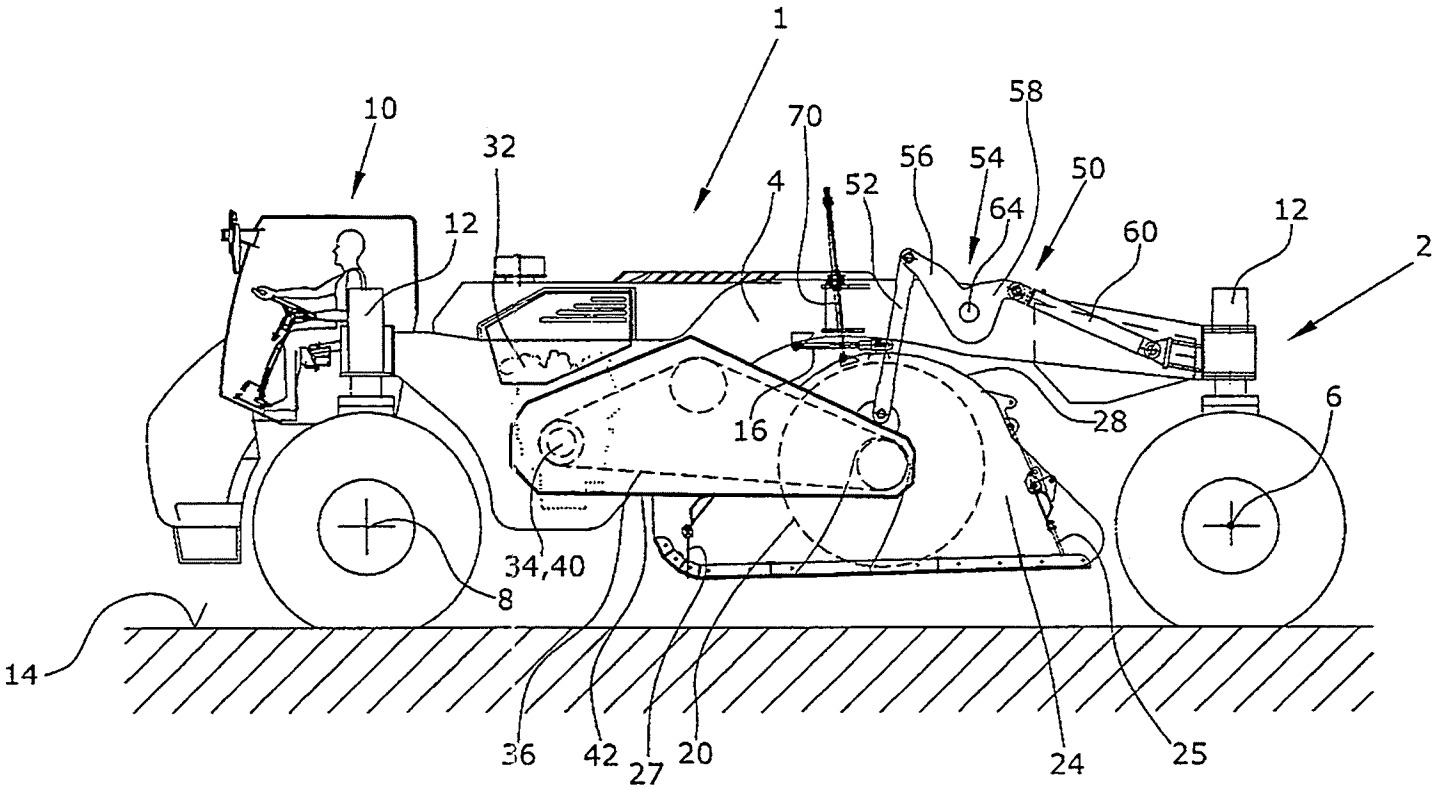
FIG. 1 is a side view of the machine in accordance with the invention in which the working drum is in an idle position.

FIG. 1 shows the machine 1 for producing and working carriageways by stabilizing insufficiently stable soils or by recycling road surfaces, with a machine chassis 4 supported by a running gear 2. The running gear 2 shows two each rear and front wheels 6, 8 that are attached to lifting columns 12 in a height-adjustable manner and that can be raised and lowered independently of each other or simultaneously. It is understood that other drive means, e.g. track chains, can also be provided in lieu of the wheels 6, 8. The lifting columns 12 are attached to the machine chassis 4.

Both axles of the running gear formed by the front and rear wheels 6, 8 respectively can be steerable.

Figure 2:
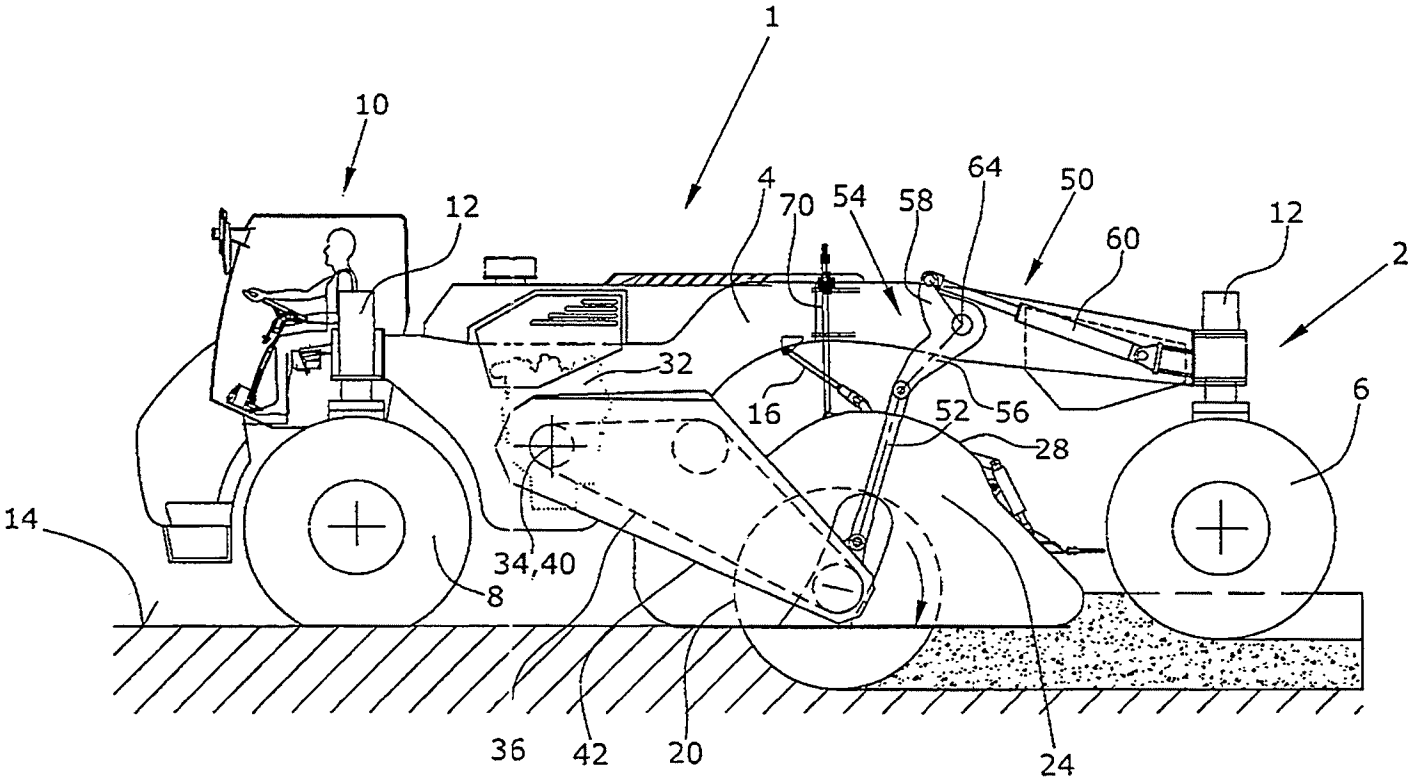
FIG. 2 is an illustration in accordance with FIG. 1 in which the working drum is in the milling position.

As can be seen from FIGS. 1 and 2, an operator's platform 10 for one operator is arranged at the machine chassis 4 above the front wheels 8 or in front of the front wheels 8, whereby a combustion engine 32 for the travel drive and for driving a working drum 20 is arranged behind the driver. In this way, the operator's platform 10 can be ergonomically optimized for the machine operator.

The working drum 20 which rotates in opposition to the direction of travel and the shaft of which extends transversely to the direction of travel, is mounted to pivot in relation to the machine chassis 4 so that it can be pivoted from an idle position, as depicted in FIG. 1, to a working position, as depicted in FIG. 2, by means of pivoting arms 42 arranged on both sides. Each pivoting arm 42 is mounted in the machine chassis 4 at one end and receives the support of the working drum 20 at its other end.

It is also possible to operate the machine 1 in a reverse direction, whereby milling then takes synchronous to the direction of travel.

The working drum 20 is, for example, equipped with cutting tools not depicted in the drawings in order to be able to work a ground surface 14.

The working drum 20 is surrounded by a cover 28 that, as can be seen from FIG. 1, can be raised together with the working drum 20 by means of the pivoting arms 42.

In the operating position, as can be seen from FIG. 2, the cover 28 rests on the ground surface 14 to be worked while the working drum 20 can be pivoted further down in accordance with the milling depth. In this way, a mixing chamber 24 with a variable mixing chamber volume that depends upon the milling depth results between the cover 28 and the working drum 20. The working drum 20 shows swiveling flaps 25, 27 at its front and rear edges. The front flap in the direction of travel is opened, and the rear flap in the direction of travel can be used as a scraper blade.

The maximum lowering of the cover 28 is determined by a limiting device 70 that consists, for example, of two threaded bars arranged at a lateral distance to each other and guided vertically through the machine chassis 4, whereby the limitation of the maximum possible downward lowering can be set by means of nuts on the threaded bar, which rest on the machine chassis 4.

Figure 3:
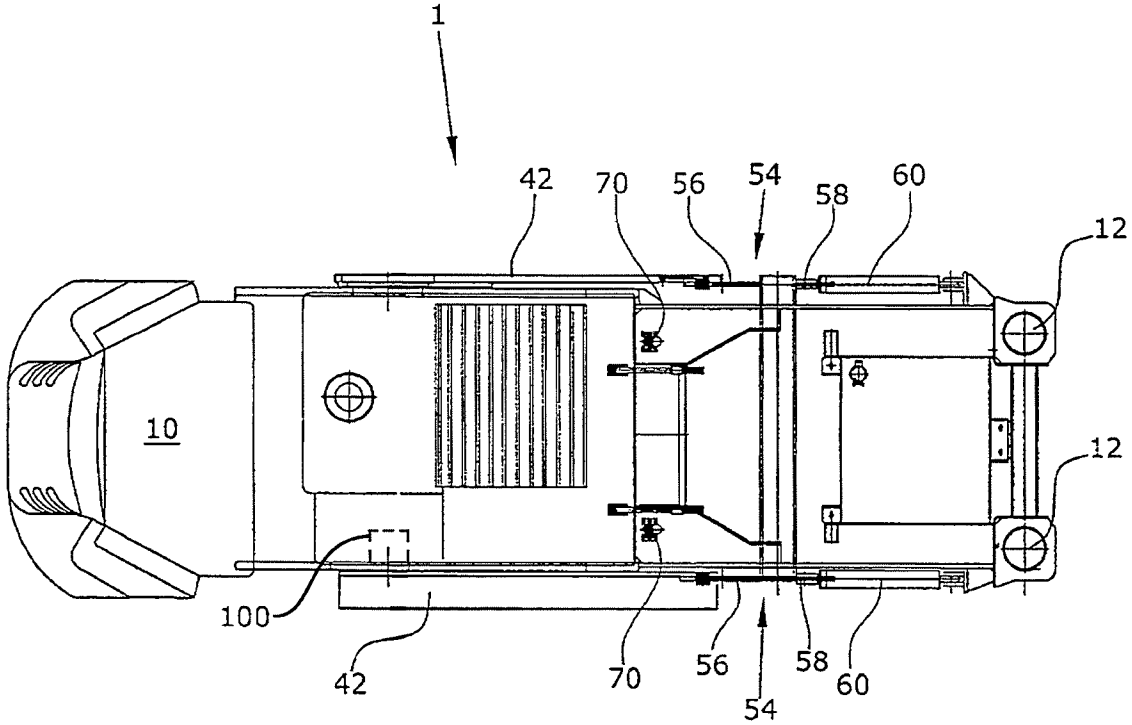
FIG. 3 is a top view of the machine in accordance with the invention.

The arrangement of the limiting device 70 in the top view can be seen from FIG. 3.

Figure 4:
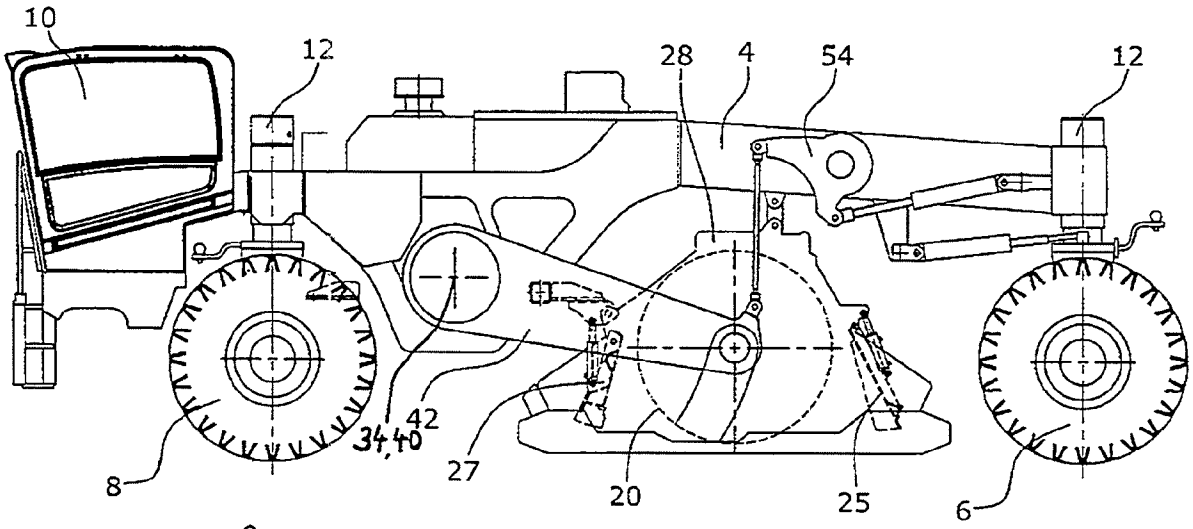
FIG. 4 is a second embodiment with a cover attached to the machine chassis in a fixed manner.
Figure 5:
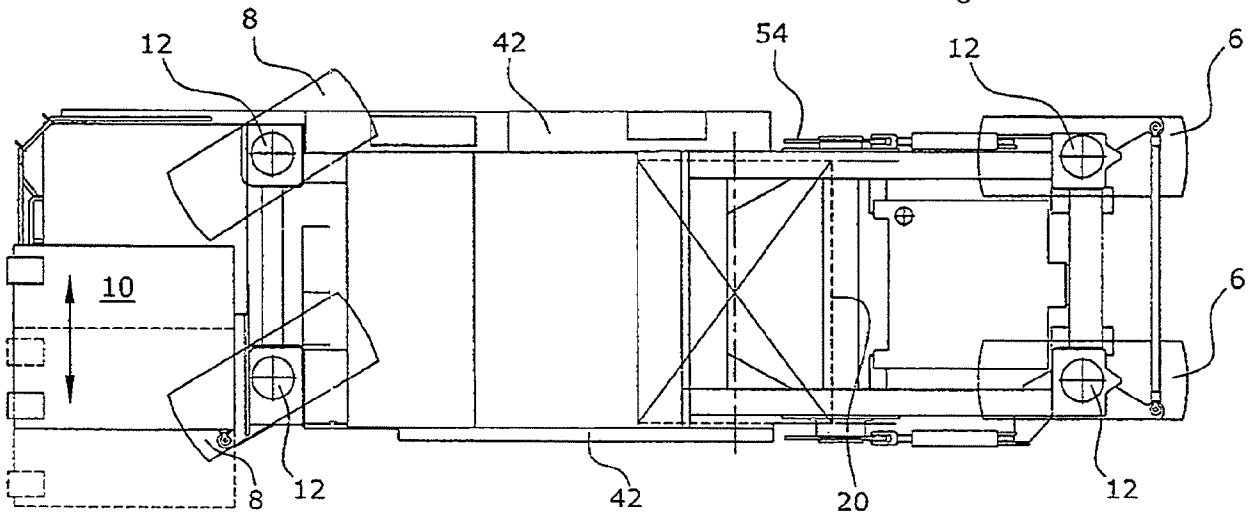
FIG. 5 is a top view of the machine in accordance with FIG. 4.

Accordingly, it is intended that such a cover 28 rests on the ground surface 14 in a floating manner. Alternatively, the cover 28 can be attached to the machine chassis 4 in a fixed manner, as shown in the embodiments of FIGS. 4 and 5.

In this case, the running gear must show lifting columns 12 in order to be able to perform a height adjustment of the cover by means of the lifting columns.

Lifting columns 12 for the wheels 6, 8 are, on the other hand, not compulsory in the embodiments shown in FIGS. 1 to 3.

A lifting device 50 for the working drum 20 consists, in detail, of two pull rods 52, flexibly attached at the front ends of the working drum on both sides, which run parallel to each other and are articulated at one or two two-armed levers 54 that are mounted in the machine chassis 4.

The two-armed lever 54 is flexibly connected at one lever arm 56 to the free end of the pull rods 52 and at the other lever arm 58 to a piston cylinder unit 60 that is attached to the machine chassis 4.

The lever arms 56, 58 of the two-armed lever 54 run at an angle of approx. 90° or more to each other. The two-armed levers 54, preferably arranged on both sides, are connected to each other in a non-rotatable manner via a coupling device 64 mounted in the machine chassis 4, preferably a pipe rod, so that a synchronous and parallel movement of the pull rods 52 is effected when actuating the at least one piston cylinder unit 60. In this way, it is ensured that the lifting device on both sides of the working drum 20 moves in a uniform manner and cannot tilt.

It is understood that two levers connected to the coupling device 64 in a non-rotatable manner can also be provided in lieu of one two-armed lever 54. FIGS. 1 and 4 show two alternative types of a two-armed lever.

The combustion engine 32 is arranged between the pivoting arms 42 in such a way that the output shaft 34, which preferably runs coaxially with the crankshaft 40, simultaneously forms the axis of rotation for the pivoting arms 42, the working drum 20 and the power transmission device 36 arranged in at least one pivoting arm 42.

A clutch 100, as best seen in FIG. 3, is preferably arranged between the output shaft 34 and the power transmission device 36 in order to be able to disconnect the working drum drive. Alternatively, a clutch can also be used in connection with a pump transfer gearbox.

The combustion engine 32 is preferably installed transversely to the direction of travel in a space-saving manner between the pivoting arms 42.

The power transmission device 36 preferably consists of belt drives, whereby one belt pulley is located on the output shaft 34 and another one is coupled to the working drum 20. The drive belts are then additionally deflected and tensioned via a tension pulley, as can be seen from FIGS. 1 and 2.

FIGS. 4 and 5 show a second embodiment in which the operator's platform 10 is arranged farther in front of the front wheels 8 or in front of the axles of the front wheels 8 respectively, and can thus be moved transversely in a favourable manner. As can be seen from FIG. 5, the operator's platform 10 can be moved even beyond the outer perimeter of the machine on one side of the machine, preferably the zero side.

This is also of particular advantage when a working drum 20 is used that extends beyond the frame width of the machine chassis. Such a working drum 20 is used, for example, when stabilizing insufficiently stable ground surfaces, as in this case the efficient working width can be increased due to the reduced performance requirements.

Deviating from the embodiment of FIGS. 1 to 3, the cover is articulated at the machine chassis 4 in a fixed manner so that a height adjustment of the cover can be effected solely by means of the lifting columns 12 for the wheels 6 and 8.

Although a preferred embodiment of the invention has been specifically illustrated and described herein, it is to be understood that minor variations may be made in the apparatus without departing from the spirit and scope of the invention, as defined by the appended claims.

What is claimed is:

1. A soil stabilizer apparatus, comprising:

a chassis having a direction of travel from a rearward end toward a forward end;

a forward running gear supporting the forward end of the chassis;

a rear running gear supporting the rearward end of the chassis, at least one of the running gears being driven so that the apparatus is self-propelled;

first and second pivot arms having upper ends pivotally connected to first and second sides, respectively, of the chassis and defining a pivotal axis transverse to the direction of travel;

a working drum located between the forward running gear and the rear running gear and mounted on the first and second pivot arms, the working drum including a drum axis extending transversely to the direction of travel; and a combustion engine arranged transversely between the pivot arms and behind the forward running gear and in front of the rear running gear, the engine having an output axis co-axial with the pivotal axis so that the pivot arms and the working drum pivot about the output axis, the engine being operably connected to the at least one of the running gears and the working drum for driving the at least one of the running gears and the working drum.

2. The apparatus of claim 1, wherein:

the forward running gear includes a pair of forward ground engaging supports;

the rear running gear includes a pair of rear ground engaging supports; and all four of the ground engaging supports are driven by the engine.

3. The apparatus of claim 2, wherein:

all four of the ground engaging supports are steerable.

4. The apparatus of claim 2, further comprising:

four lifting columns supporting the chassis from the four ground engaging supports, so that a height of the chassis above the ground surface may be adjusted.

5. The apparatus of claim 1, wherein the output axis is defined by a crankshaft axis of the combustion engine.

6. The apparatus of claim 1, further comprising:

an operator's platform supported from the chassis and transversely movable relative to the chassis.

7. The apparatus of claim 1, further comprising:

a lifting linkage including:

first and second two-armed levers located on opposite sides of the chassis;

first and second piston cylinder units connected between the chassis and the first and second two-armed levers; and first and second pull rods connected between the first and second two-armed levers and the first and second pivot arms, respectively.

8. A soil stabilizer apparatus, comprising:

a chassis having a direction of travel from a rearward end toward a forward end;

a forward running gear supporting the forward end of the chassis;

a rear running gear supporting the rearward end of the chassis, at least one of the running gears being driven so that the apparatus is self-propelled;

first and second pivot arms having upper ends pivotally connected to first and second sides, respectively, of the chassis and defining a pivotal axis transverse to the direction of travel;

a working drum located between the front running gear and the rear running gear and mounted on the first and second pivot arms, the working drum including a drum axis extending transversely to the direction of travel;

a combustion engine arranged between the pivot arms and behind the forward running gear and in front of the rear running gear, the engine having an output axis co-axial with the pivotal axis so that the pivot arms and the working drum pivot about the output axis; and a power transmission device received by the first pivot arm to transfer drive power from the engine to the working drum, the power transmission device including a belt drive including a first pulley driven by the engine, a second pulley for driving the drum, a drive belt connecting the first and second pulleys, and a tension pulley deflecting and tensioning the drive belt, the belt drive pivoting with the working drum and the pivot arms about the pivotal axis.

9. The apparatus of claim 8, wherein:

the second pivot arm extends laterally outward from the chassis a shorter distance than does the first pivot arm, so that the apparatus can operate closer to an obstacle on the second side of the chassis than it can on the first side of the chassis.

10. The apparatus of claim 9, wherein:

the power transmission device received by the first pivot arm is the one and only one power transmission device transferring drive power from the engine to the working drum.

11. The apparatus of claim 8, further comprising:

an operator's platform located on the chassis, the operator's platform being transversely movable relative to the chassis.

12. A soil stabilizer apparatus, comprising:

a chassis having a direction of travel from a rearward end toward a forward end;

a forward running gear supporting the forward end of the chassis;

a rear running gear supporting the rearward end of the chassis, at least one of the running gears being driven so that the apparatus is self-propelled;

first and second pivot arms having upper ends pivotally connected to first and second sides, respectively, of the chassis and defining a pivotal axis transverse to the direction of travel;

a working drum located between the front running gear and the rear running gear and mounted on the first and second pivot arms, the working drum including a drum axis extending transversely to the direction of travel;

a combustion engine arranged between the pivot arms and behind the forward running gear and in front of the rear running gear, the engine having an output axis co-axial with the pivotal axis so that the pivot arms and the working drum pivot about the output axis;

a power transmission device received by the first pivot arm to transfer drive power from the engine to the working drum; and an operator's platform supported from the chassis and transversely movable relative to the chassis.

13. The apparatus of claim 12, wherein:

the operator's platform is located on the chassis forward of the combustion engine.

14. The apparatus of claim 12, wherein:

the operator's platform is located in front of the forward running gear.

15. The apparatus of claim 12, wherein:

the forward running gear includes two front wheels mounted on front axles; and the operator's platform is located in front of the front axles.

16. A soil stabilizer apparatus, comprising:

a chassis having a direction of travel from a rearward end toward a forward end;

a forward running gear supporting the forward end of the chassis;

a rear running gear supporting the rearward end of the chassis, at least one of the running gears being driven so that the apparatus is self-propelled;

first and second pivot arms having upper ends pivotally connected to first and second sides, respectively, of the chassis and defining a pivotal axis transverse to the direction of travel;

a working drum located between the front running gear and the rear running gear and mounted on the first and second pivot arms, the working drum including a drum axis extending transversely to the direction of travel;

a combustion engine arranged between the pivot arms and behind the forward running gear and in front of the rear running gear, the engine having an output axis co-axial with the pivotal axis so that the pivot arms and the working drum pivot about the output axis; and a mechanical power transmission device received by the first pivot arm to transfer drive power from the engine to the working drum, the power transmission device including a belt drive including a first pulley coupled to the engine, a second pulley coupled to the drum, and a drive belt connecting the first and second pulleys, the belt drive pivoting with the working drum and the pivot arms about the pivotal axis; and a clutch operably connected between the engine and the power transmission device.

17. The apparatus of claim 16, wherein:

the belt drive further includes a tensioning pulley engaging the drive belt.

18. The apparatus of claim 16, wherein:

the second pivot arm extends laterally outward from the chassis a shorter distance than does the first pivot arm, so that the apparatus can operate closer to an obstacle on the second side of the chassis than it can on the first side of the chassis.

19. The apparatus of claim 16, further comprising:

an operator's platform located on the chassis, the operator's platform being transversely movable relative to the chassis.

* * * * *